US005205966A

United States Patent [19]

Elmaleh

[11] Patent Number: 5,205,966

[45] Date of Patent: Apr. 27, 1993

[54] PROCESS FOR HANDLING LOW LEVEL RADIOACTIVE WASTE

[75] Inventor: David Elmaleh, Brookline, Mass.

[73] Assignee: David R. Elmaleh, Brookline, Mass.

[21] Appl. No.: 763,116

[22] Filed: Sep. 20, 1991

[51] Int. Cl.[5] ..... G21F 9/00

[52] U.S. Cl. ..... 252/626; 252/633; 250/506.1; 376/272; 976/DIG. 388

[58] Field of Search ..... 252/626, 633; 280/506.1; 376/272; 976/DIG. 388

[56] References Cited

U.S. PATENT DOCUMENTS

| | | | |
|---|---|---|---|
| 2,404,722 | 10/1968 | Bloore | 159/23 |
| 3,361,649 | 1/1968 | Karter | 203/12 |
| 3,663,817 | 5/1972 | Sayers | 250/506.1 |
| 4,016,096 | 4/1977 | Meyer | 252/626 |
| 4,058,479 | 11/1977 | White et al. | 252/628 |
| 4,290,908 | 9/1981 | Horiuchi et al. | 252/633 |
| 4,357,541 | 11/1982 | Ernst | 250/507.1 |
| 4,410,802 | 10/1983 | Szulinski | 250/515.1 |
| 4,414,475 | 11/1983 | Kratz et al. | 250/506.1 |
| 4,422,964 | 12/1983 | Capolupo | 252/628 |
| 4,446,063 | 5/1984 | Critchley et al. | 252/633 |
| 4,524,048 | 6/1985 | Schmidt et al. | 422/159 |
| 4,572,959 | 2/1986 | Popp et al. | 250/506.1 |
| 4,581,163 | 4/1986 | Meininger et al. | 252/633 |
| 4,588,088 | 5/1986 | Allen | 206/525 |
| 4,590,000 | 5/1986 | Baatz et al. | 252/633 |
| 4,592,192 | 6/1986 | Jacob et al. | 53/512 |
| 4,599,518 | 7/1986 | Schmidt et al. | 250/507.1 |
| 4,610,199 | 9/1986 | Pols | 100/269 |
| 4,626,414 | 12/1986 | Baatz et al. | 422/159 |
| 4,633,091 | 12/1986 | Kurasch et al. | 250/506.1 |
| 4,641,789 | 2/1987 | Moscardini | 241/31 |
| 4,661,290 | 4/1987 | Sauda et al. | 252/626 |
| 4,681,706 | 7/1987 | Mallory et al. | 252/633 |
| 4,760,268 | 7/1988 | Noe | 250/506.1 |
| 4,760,783 | 8/1988 | Torita et al. | 100/137 |
| 4,833,866 | 5/1989 | Newton et al. | 53/529 |
| 4,834,914 | 5/1989 | Jackson | 252/633 |
| 4,897,221 | 1/1990 | Manchak, Jr. | 252/633 |
| 4,907,717 | 3/1990 | Kubofcik | 220/404 |
| 4,929,394 | 5/1990 | Kitagawa et al. | 252/633 |
| 4,980,132 | 12/1990 | Stinson et al. | 422/159 |
| 4,996,019 | 2/1991 | Catalayoud et al. | 376/272 |

*Primary Examiner*—Donald P. Walsh
*Assistant Examiner*—Ngoclan T. Mai
*Attorney, Agent, or Firm*—Testa, Hurwitz & Thibeault

[57] ABSTRACT

A process for the continuous disposal of radioactive waste is disclosed. The process involves (a) separating materials contaminated with radionuclides into categories containing radionuclides with similar half-lives; (b) accumulating radioactive materials for each category in containers over a predetermined time interval; (c) sealing the containers and storing them until the radioactivity is reduced to safe levels; (d) disposing of the material as conventional waste; and (e) repeating steps (a) through (d) with a new batch of material. The method can be practically used to process radioactive wastes having half-lives of up to 50 years.

20 Claims, 2 Drawing Sheets

PROCESS FOR HANDLING LOW LEVEL RADIOACTIVE WASTE

BACKGROUND OF THE INVENTION

Radioactive nuclides are used for basic research and testing purposes in fields such as medicine, pharmaceuticals, genetics, molecular biology, cancer research and AIDS research. Radionuclides are used, for example, for imaging, radioimmunoassays and other assays for viruses, bacteria, antigens or antibodies; for labeling proteins, antibodies or radiopharmaceticals and for myriad other uses. Most of the radionuclides used for these purposes are "low level" isotopes which generally have half-lives of less than 50 years. About 97% of low level waste consists of radionuclides with half-lives of less than 10 years.

Disposal of low level radioactive waste is becoming more and more difficult. Radionuclides used in research, treatment and testing by hospitals, research laboratories and biotechnology companies are essential to their continued productivity. More than eighty percent of funded biomedical research utilizes radioactive isotopes.

The availability of radioactive waste disposal is diminishing and the cost is escalating. Many users are forced to maintain facilities for storing radioactive waste on site until it decays sufficiently to be disposed as conventional waste, which may take years. Such facilities are expensive to build and operate.

Methods currently used to handle radioactive waste are either very costly, or impractical for many users. For example, in U.S. Pat. No. 3,663,817, Sayers describes a method for storing radioactive waste by placing the waste in carriage containers which are mounted on storage racks. The containers are moved along the racks for a time necessary to ensure decay of the radioactive waste to safe levels. The method requires a complex and expensive apparatus and sufficient space to set up and operate the apparatus.

In U.S. Pat. No. 4,290,908, Horiuchi et al. describe a method and apparatus for treating and storing radioactive waste in which the material is dried to a powder and pelletized, and the pellets are stored until the radioactivity is reduced to safe levels. The pellets are then sealed in a vessel with a binder and the entire package is disposed.

Ernst in U.S. Pat. No. 4,357,541 describes a method for storing radioactive waste having very short half-lives. The waste is dropped into a bag in a compartment which is then closed and the device is rotated. At the end of the rotation, the bag is dropped through the bottom of the compartment into a receptacle to be disposed as ordinary waste.

Szulinski in U.S. Pat. No. 4,710,802 describes a storage depot for radioactive wastes consisting of holes drilled in the soil containing receptacles for storing the waste. The container is sealed and buried until the radioactive decay has declined to safe levels.

None of these prior methods or devices provides a continuous method for systematically disposing of radioactive waste. A system for safely and efficiently managing low level radioactive waste is urgently needed.

SUMMARY OF THE INVENTION

The present invention relates to a system for continuously disposing of low level radioactive materials which are contaminated with radionuclides having half-lives of 50 years or less. The system is based on a process comprising the following general steps: (a) separating the wastes by half-life and grouping radionuclides having similar half-lives together; (b) accumulating each group in a series of batches for a predetermined time interval dependant on the half-life group or category; (c) storing the series of batches for a time sufficient to reduce the radioactivity in the oldest batch in a series to a level permitting disposal of the material as conventional waste; (d) disposing of the oldest batch; and (e) repeating the process by sequentially disposing of the oldest batch in the series, and refilling or replacing the batch with a new batch thereby creating a continuous cycle.

The process can practically be applied only to radionuclides having a half-life of about 50 years or less, since the storage time for each batch must be about 7 to 10 half-lives of the isotope having the longest half-live in the batch. Batches containing isotopes having half-lives of fifty years, for example, must be stored for between 350 to 500 years. The process is particularly useful for radioisotopes having half-lives of 12 years or less, which encompasses most radionuclides used in medicine and research. More than 90% of low level waste is classified as Class A waste, that is, it has a half life of 12 years or less.

In one embodiment of the present system, materials contaminated by radionuclides having half-lives of 50 days or less are batched together and accumulated for a predetermined time interval in a container. The interval can be, for example, one day. After one day the container is sealed and stored in an organized storage area. The process is repeated each day for a year, so that 365 containers are filled. The storage area is set up so that the containers are filled each day and lined up serially. After 1 year, which is 7.3 half-lives of the isotopes having a 50 day half-life, the first container is removed from storage and the material is disposed as conventional waste. The container can then be refilled, sealed in the storage area, and the cycle started over again.

Simultaneously, radioactive wastes having half-lives of from 50 days to one year are batched together and accumulated, for a second predetermined interval, e.g., for one month. The containers are then sealed and stored serially as they are filled. At the end of seven to ten half-lives of the longest lived isotope, in this case 7 to 10 years, the first container is opened and the waste disposed of as conventional waste. The container then is refilled and the cycle is repeated.

Parallel series of sites can be set up to store the different categories of batches. The system can be adapted to handle radioactive wastes having any half-lives, but is most useful for radionuclides having half-lives of 50 years or less, preferably 12 years or less.

The storage facility can be on site or can be a separate area. The storage units or containers for holding the radioactive wastes can be stored in a vault, for example, or in underground or above ground storage areas. The storage unit or container generally comprises an outer casing sufficient to prevent the escape of radioactivity, and preferably weather resistant and corrosion resistant. Means for monitoring the level of radioactivity of contaminated matter placed inside the unit may be integrated into the unit such that waste having a half-life too long to decay sufficiently in the storage interval is not inadvertently placed in the unit. The unit also can contain means for trapping radioactive gases, means for introducing an inert gas into the container, pressure release means and, optionally, refrigerations means to preserve perishable materials. The unit is adapted to contain radioactive materials which are in solid, liquid and/or gaseous form. Means for crushing, shredding or compacting the waste, thereby reducing the volume of material to be stored can be included.

The present system provides an efficient process for managing low level radioactive wastes on a continuing basis. The sites and the containers, can be reused over and over again, thereby minimizing the amount of storage space needed, particularly for short-lived isotopes. The system permits on site permanent disposal of wastes in a room or region within a facility that generates a continuous stream of wastes having widely disparate half-lives, with daily, weekly or monthly disposal of waste decayed to a level where it can legally and safely be stored with conventional solid wastes.

The key insight is to separate waste of disparate half-lives into categories of similar half-lives, then to accumulate each batches in each category for an interval of a day to a few weeks, months or years depending on the half-life of the isotopes, and then to store the batch in an appropriate container for a time sufficient to permit the waste in the batch to decay through, e.g., seven to ten half-lives, so that it can be disposed of as conventional waste, and the container can be reused. Alternatively, the container can be disposable so that the container and waste can be disposed. Once the system is in place, it effectively becomes a disposal facility that is continuously operable, safe, and self-contained, with a waste output that can be incinerated, stored in a land fill, or otherwise disposed of conventionally.

The system cannot be implemented effectively if the keystone step of segregating the waste into categories of batches of common half-lives is omitted, as otherwise one must store waste of different half-lives together, and conventional disposal of the waste is not possible until the longest half-life component of the batch is stored for a time sufficient to decay to safe radioactive levels. This, of course, would defeat essentially all of the advantageous features of the system of this invention.

DETAILED DESCRIPTION OF THE INVENTION

Low level radioactive waste is defined as all radioactive waste which is not classified as spent fuel, high level waste or uranium mill tailings. Low level radioactive materials include isotopes such as, for example, $^{32}P$, $^{125}I$, $^{131}I$, $^{99m}Tc$, $^{133}Xe$, $^{134}Cs$, $^{60}Co$, $^{54}Mg$ and $^{3}H$. Half-life is the amount of time it takes a radioactive substance to lose half of its radioactivity. For example, a radioactive material with a 50 day half-life will be reduced from 1 curie of radioactivity to 0.5 curie in 50 days. In another 50 days, it is down to 0.25 curie. By the end of one year, or 7.3 half-lives, the radioactivity will be reduced to 0.0005 curie, a decrease of over 2000 times of the original activity.

Figure 1:
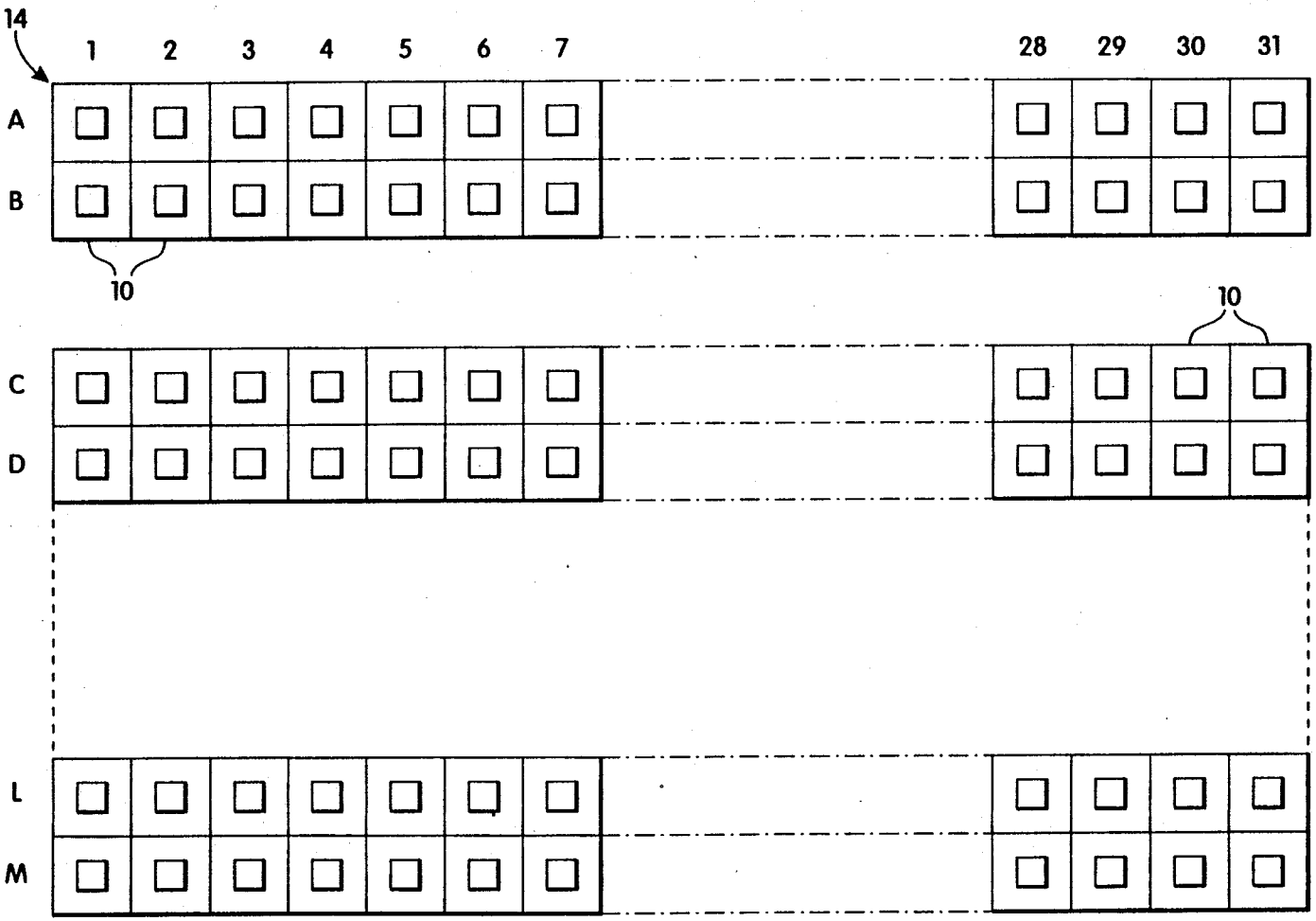
FIG. 1 is a schematic diagram showing the configuration of a site for storing radioactive wastes having half-lives of 50 days or less.

A system for carrying out the process of the invention is shown schematically in FIG. 1. The embodiment shown in FIG. 1 illustrates the design of a site for systematically disposing of radioactive waste having a half-life of 50 days or less. On day 1, radioactive wastes (such as laboratory equipment including gloves, test tubes, clothing, microtiter trays, which have been contaminated with various radioisotopes are separated into categories according to half-life. The waste may also contain contaminated carcasses of experimental animals or other perishable materials, which must be refrigerated while stored. In general, the waste is separated and labeled at the originating source. The wastes contaminated with radioisotopes having a half-life of 50 days or less are batched together, and placed in a container designed to hold radioactive waste. The container is represented by the number 12 in FIG. 1. The site is made up of 365 units, one for each day of the year. There are rows of storage units corresponding to each month and, There are rows of storage units corresponding to each month and, within each row, are containers for that month's number of days.

After 1 day, the container is sealed, and placed in storage area 14, which is designed to receive it. Storage area 14 can be, for example, an underground storage area, a vault, or simply a room in the facility that generates the waste. Alternatively, it can be a site which receives waste from a plurality of waste generating sites in a particular geographic area. On day 2, the process is repeated with a second storage container, and the second container is stored in area 2 as shown in FIG. 1. This procedure is carried out each day until all 365 of the containers are filled. The containers are sealed until the radioactivity has declined to safe levels, which generally occurs within 7 to 10 half-lives of the longest lived isotope in the batch. The containers are stored for a minimum of seven half-lives of the longest lived isotope in the batch. In the present embodiment, the first container can be reopened after about 1 year, which is 7.3 half-lives of the 50 day isotopes. Thus, the contents of container 1 have been reduced to safe levels and can be disposed as conventional waste. Container 1 then can be refilled with 50-day waste, sealed and stored for another year. These disposal and refilling steps are repeated daily for each successive container. Thus, on day 366, the disposal and refilling system is operating at full capacity.

Simultaneously, radioactive wastes having half-lives of between 50 days and one year are batched together and accumulated in a container for a predetermined interval, e.g., for one month. At the end of each month, the container is sealed and deposited in a storage area. This process continues each month, for, e.g., ten years. Ten years is ten half-lives of the longest lived isotope in the batch. A total of 120 units are filled and stored. After ten years, container 1 is opened and the contents disposed as conventional waste. Container 1 is refilled, and the cycle begins again.

Simultaneously, radioactive waste having half-lives of up to five years are batched and stored as described above. This site will hold waste with half-lives of up to five years. There will be 250 units total. Each batch is accumulated for about 70–75 days, that is, five containers per year are filled, sealed and stored. Five units are filled every year for 50 years. At the end of 50 years, the first unit's contents can be disposed, and the process can begin again.

Figure 2:
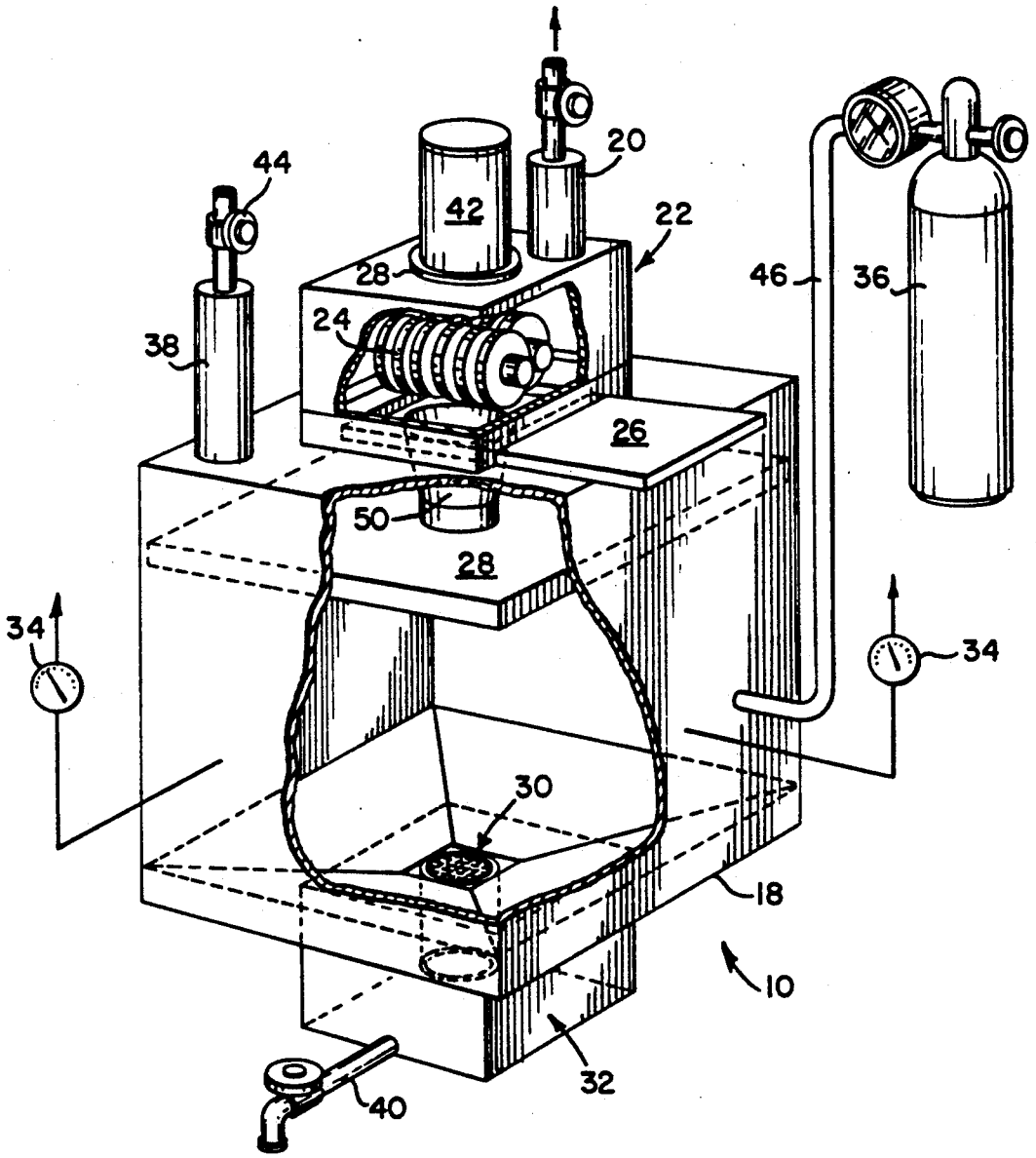
FIG. 2 is a schematic perspective view of a container for storing radioactive wastes.

An exemplary storage unit for use in the present system is shown in FIG. 2. The storage unit is designed to fit together with a plurality of like units into an storage area such as a vault, underground or above ground site. As shown in FIG. 2, storage unit 10 comprises a container 18 which is adapted to contain the radioactivity for the storage period without leakage or failure. The unit has a sealable port 26, and means for monitoring the radioactivity 34. A portion of the unit is preferably adapted to contain liquids. This can be accomplished by incorporating a liquid storage area 32, in the bottom of the unit. The liquids will first pass through a column 30 containing activated charcoal or other material capable of trapping the radioactive compounds in the liquid, thereby removing them from the liquid. The liquid can then be pumped or drained out, for example, through line 40, and further treated or disposed. The unit preferably contains pressure release means comprising a column 38 filled with charcoal or other material capable of trapping radioactive compounds and a valve 44. Radioactive gases pass through column 38 prior to being released through valve 44. The storage unit can contain means for introducing an inert gas into the containers. In the embodiment shown in FIG. 2, line 46 is connected to a nitrogen tank 36.

Storage unit 10 is adapted to interface with crusher unit 22. Sealable port 26 is designed to interfit with the base of crusher unit 22 so that an air-and liquid-tight seal is formed between the base of crusher unit 22 and the top of storage unit 10. When the unit 10 is to be filled with radioactive material, crusher unit 22 is placed on the top. Radioactive materials which are to be stored in the unit are introduced into the top crusher unit 22 through port 28. Port 28 is designed to interfit to form an air-and liquid-tight seal with a barrel 42 filled with the radioactive material. The barrel 42 is attached to port 28 and the radioactive material is emptied into crusher unit 22. A column 20 filled with a material capable of collecting and trapping radioactive gases is incorporated in crusher unit 22. Crusher unit 22 contains a rotating crushing or shredding means 24. Thus, the radioactive waste is broken up or crushed and thereby reduced to small packable debris. Liquid waste flows directly through the crusher unit through port 50 into the bottom of the box 18. The bottom is preferably angled to direct liquid waste through column 30 into liquid storage area 32.

Once the box 18 is filled within the predetermined interval, the solid material can be further compressed using hydraulic plate 28. The crusher unit 22 is then removed and port 26 is sealed. The unit is then buried or otherwise stored for the decay period.

In a preferred embodiment of the system, the wastes are crushed or shredded prior to being placed in the container. This step allows bulky glass and/or plastic items to be reduced to small pieces which pack more closely together. Nitrogen can be introduced into the container to provide an inert atmosphere, thereby preventing the contents from oxidizing. Refrigeration means can be included to pressure perishable materials, such as animal carcasses, to prevent their decay in the container. The contents can be monitored by a detection means which monitors radioactive decay.

A frequently used medical isotope that will not be included in the above disposal method is Carbon 14, which has a half-life of 5,700 years. However, the amounts of Carbon 14 that are produced artificially are far less than the amount of C14 that is found naturally in the atmosphere. The amounts of very long-lived isotopes such as Cesium-137, Strontium-90, Nickel-61, Nickel-59, Iodine-129, Uranium-235, and Uranium-238 account for less than 10% of radioactive produced. Therefore, the present system eliminates at least 90% of all waste produced.

The present process reduces the need for further sites, and for recycling the current sites. disposal costs are reduced due to the savings in land costs with the present system.

EQUIVALENTS

Those skilled in the art will be able to ascertain many equivalents to the specific embodiments described herein. Such equivalents are intended to be covered by the following claims.

I claim:

1. A process for continuous disposal of materials comprising plural different radionuclides, each having a half-life of less than 50 years, the process comprising the steps of:

a. separating the radionuclides into plural categories, each comprising radionuclides having similar half-lives;

b. accumulating for a fixed time interval predetermined for each category, radionuclides from each category to form a series of batches of waste in each category, the time interval being different for each category;

c. placing each batch in a static storage unit and storing the serially accumulated batches in each category for a time period sufficient to reduce the level of radioactivity of the oldest batch in the series to a level permitting disposal of the material as conventional waste;

d. at the end of the time period in step (c), removing said oldest batch from said storage unit; and e. repeating steps (a), (b), (c), and (d), in such a way that a new batch of waste is placed in the storage unit from which said oldest batch has been removed for disposal, thereby providing a continuous system for disposal of said waste.

2. The process of claim 1 wherein the material comprising radionuclides belonging to a first category and having a half-life of less than about 50 days; and wherein the time interval of step (b) for said first category is from about 1 to about 7 days.

3. The process of claim 2 wherein each batch for the first category is stored for about 1 year.

4. The process of claim 1 wherein the material comprises radionuclides belonging to a second category and having a half-life of from about 50 days to 1 year; and wherein the time interval of step (b) for the second category is about 1 month.

5. The process of claim 4 wherein each batch for the second category is stored for at least 7 years.

6. The process of claim 1 wherein the material comprises radionuclides belonging to a third category and having a half-life of from about 1 year to 5 years; and wherein the time interval step (b) for the third category is about 70 days.

7. The process of claim 6 wherein each batch for the third category is stored for at least 35 years.

8. The process of claim 1 wherein the material comprises radionuclides belonging to a fourth category and having a half-life of from about 12 years to 50 years; and wherein the time interval of step (b) for the fourth category is about one year.

9. The process of claim 8 wherein each batch for the fourth category is stored for at least 350 years.

10. The process of claim 1 wherein the batches are stored in reusable containers.

11. The process of claim 1 wherein the batches are stored in disposable containers.

12. The process of claim 1 further comprising the step of crushing or shredding the materials prior to storage.

13. The process of claim 1 further comprising monitoring the level of radioactivity of each batch.

14. The process of claim 1 wherein the materials are perishable, further comprising a step of refrigeration of the materials during the step of storing.

15. The process of claim 1 further comprising the step of storing a batch under nitrogen.

16. The process of claim 1 wherein the radioactive materials comprise laboratory equipment, protective clothing, test samples or animal carcasses which are contaminated with one or more radionuclides.

17. The process of claim 1 wherein the material comprises radionuclides belonging to at least one of the following categories:

a first category having a half-life of less than about 50 days, wherein the time interval of step (b) for the first category is from about 1 day to about 7 days, and wherein each batch for the first category is stored for about 1 year, a second category having a half-life of from about 50 days to 1 year, wherein the time interval of step (b) for the second category is about 1 month, and wherein each batch for the second category is stored for at least 7 years, a third category having a half-life of from about 1 year to 5 years, and wherein the time interval step (b) for the third category is about 70 days, and wherein each batch for the third category is stored for at least 35 years, and a fourth category having a half-life of from about 12 years to 50 years, and wherein the time interval of step (b) for the fourth category is about one year, and wherein each batch for the fourth category is stored for at least 350 years.

18. The process of claim 17 further comprising monitoring the level of radioactivity of each batch.

19. The process of claim 18 wherein the radioactive materials comprise laboratory equipment, protective clothing, test samples or animal carcasses which are contaminated with one or more radionuclides.

20. The process of claim 19 wherein the materials are perishable, further comprising a step of refrigeration the materials.

* * * * *